US006161984A

United States Patent [19]

Sinclair

[11] Patent Number: 6,161,984

[45] Date of Patent: Dec. 19, 2000

[54] MANHOLE OR CATCH BASIN ASSEMBLY

[76] Inventor: David Brent Sinclair, 60 Morgan Road, Baie d'Urfe, Quebec, Canada, H9X 3A4

[21] Appl. No.: 09/372,572

[22] Filed: Aug. 12, 1999

[51] Int. Cl.[7] ..... G02D 29/14

[52] U.S. Cl. ..... 404/25

[58] Field of Search ..... 404/25, 26

[56] References Cited

U.S. PATENT DOCUMENTS

| | | | |
|---|---|---|---|
| 4,103,901 | 8/1978 | Ditcher . | |
| 4,188,151 | 2/1980 | Hall | 404/26 |
| 4,834,574 | 5/1989 | Bowman | 404/26 |
| 5,044,818 | 9/1991 | Pritchard | 404/26 |
| 5,482,400 | 1/1996 | Bavington | 404/25 |
| 5,496,128 | 3/1996 | Odill | 404/25 |
| 5,513,926 | 5/1996 | Prescott | 404/26 |
| 5,525,006 | 6/1996 | Kilman et al. | 404/25 |
| 5,564,855 | 10/1996 | Anderson . | |
| 5,956,905 | 9/1999 | Wiedrich | 52/20 |
| 5,966,876 | 10/1999 | Neathery et al. | 52/20 |

FOREIGN PATENT DOCUMENTS

WO98/35107 8/1998 WIPO .

OTHER PUBLICATIONS

USSN 09/339,249–filed Jun. 24, 1999, Group Art Unit 3671, David Brent Sinclair.

*Primary Examiner*—Eileen D. Lillis
*Assistant Examiner*—Raymond W Addie
*Attorney, Agent, or Firm*—Swabey Ogilvy Renault

[57] ABSTRACT

A manhole or catch basin assembly comprises separable component parts which assemble to a unitary structure, the component parts being readily replaced or interchanged to increase the vertical height of the assembly such as when a road surface is repaved to an elevated height; the component parts are molded parts which fit snugly together in sealing engagement.

31 Claims, 5 Drawing Sheets

MANHOLE OR CATCH BASIN ASSEMBLY

BACKGROUND OF THE INVENTION a) Field of the Invention

This invention relates to a manhole or catch basin assembly and more especially a manhole or catch basin assembly comprising separable component parts which assemble to a unitary structure, still further the invention relates to a frame as a principal component of such manhole or catch basin assembly, to an assembly of a lower structure and a manhole or catch basin assembly and to a method of inhibiting transmission of mechanical vibrations through a manhole or catch basin assembly to a lower structure.

b) Description of Prior Art

Manholes which provide access to sewers or utility components and catch basins for removal of rainwater, typically employ a lower support structure, for example, a concrete riser in which access steps may be mounted, a frame assembly typically of metal above the lower structure and a removable cover typically of metal to close and permit access to the lower structure and a conduit network communicating with the concrete riser.

A manhole typically has access steps to facilitate entry into the hole.

An adjustment riser is disposed between the lower structure, for example, a concrete riser and the frame assembly. The adjustment riser has two functions, first it occupies the gap between the lower structure and the frame assembly to complete the assembly of the manhole or catch basin hole, and secondly it absorbs mechanical vibrations developed above the frame assembly, such as by vehicles travelling over the metal cover when the hole is located in a road, and inhibits transmission of the mechanical vibrations to the lower structure, which mechanical vibrations would otherwise cause fractures or cracking in a concrete riser as the lower structure, shortening its life such that frequent repair or replacement becomes necessary.

In that the adjustment riser is to occupy a gap formed in part as a result of a lack of exactness in dimensions of components of the manhole or catch basin; and in part as a result of variations in requirements of different hole structures, such adjustment risers are fabricated in a variety of different thicknesses to accommodate different gap heights between the lower structure and the frame assembly in different holes. An adjustment riser of required thickness or a combination of thicknesses is then selected based on measured dimensions of the gap at a particular hole structure.

The component parts of a manhole or catch basin assembly are typically manufactured at poor manufacturing precision, such that a cover or closure member which is the uppermost component located generally flush with an exposed paved surface such as a road surface, fits poorly in the manhole or catch basin assembly and may bounce or vibrate as vehicles travel over it. The other components of the assembly also poorly fit and gaps exist which provide a path for flow of water throughout the assembly structure.

Furthermore, the frame, which is the principal component of the manhole or catch basin assembly is typically of cast iron and thus is heavy, transmits mechanical vibrations to the underlying concrete conduit, which vibrations frequently produce cracks in the concrete conduit and is subject to corrosion from water leakages.

SUMMARY OF THE INVENTION

It is an object of this invention to provide a manhole or catch basin assembly comprising separable component parts which assemble to a unitary structure.

It is a specific object of this invention to provide such a manhole or catch basin assembly in which component parts are readily interchanged to increase the vertical height of the assembly, for example, when the height of an installed assembly needs to be increased to match the raised height of a repaved surface in which the manhole assembly is disposed.

It is a ftirther object of this invention to provide a frame as a component of such a manhole or catch basin assembly.

It is yet another object of this invention to provide an assembly of a lower structure and a manhole or catch basin assembly of the invention.

It is yet another object of this invention to provide a method of inhibiting transmission of mechanical vibrations through a manhole or catch basin assembly of the invention to a lower adjacent structure.

It is a further object of the invention to provide such a manhole or catch basin assembly in which the component parts particularly the frame are of reduced weight and thus easier to transport and handle; and also of reduced thickness whereby the cure time of molded component parts is reduced.

It is still a further object of the invention to provide such a manhole assembly in which the component parts matingly, sealingly engage and are, more particularly, self-sealing, thereby inhibiting leakage of water between the component parts.

In accordance with one aspect of the invention there is provided a manhole or catch basin assembly comprising: a) a molded frame member having a peripheral frame wall defining an access opening, said frame wall having an upper end and a lower face extending outwardly of said access opening, b) seat means defined in said upper end, said seat means comprising an upper outer seat and a lower inner seat, said upper seat circumscribing and being spaced above said lower seat, c) a molded upper assembly member having a peripheril wall defining said access opening, matingly supported by said upper seat, and d) a molded first adjustment riser matingly engaging said lower face of said frame member such that lateral movement of the adjustment riser relative to the frame member is inhibited.

In accordance with another aspect of the invention there is provided a manhole or catch basin assembly frame comprising: i) a molded frame member having a peripheral frame wall defining an access opening, said frame wall having an upper end and a lower face extending outwardly of said access opening, ii) seat means defined in said upper end, said seat means comprising an upper outer seat and a lower inner seat, said upper seat circumscribing and being spaced above said lower seat, iii) said lower seat being adapted to matingly support an outer peripheral edge of an upper assembly member disposed above said frame, and said upper seat being adapted to matingly support the same or a further assembly member disposed above said frame, iv) said lower face of said frame wall having means to matingly engage an adjustment riser such that lateral movement of the adjustment riser relative to the frame member is inhibited.

In accordance with still another aspect of the invention there is provided in an assembly of a lower structure and a manhole or catch basin assembly in which the manhole or catch basin assembly is exposed to vibration generating impacts, the vibrations being transmissible through said manhole or catch basin assembly to said lower structure, and wherein said manhole or catch basin assembly has an adjustment means to absorb mechanical vibrations transmitted through said assembly and inhibit transmission of the vibrations to the lower structure, the improvement wherein the manhole or catch basin assembly is a manhole or catch basin assembly of the invention as defined hereinbefore.

In accordance with yet another aspect of the invention there is provided a method of inhibiting transmission of mechanical vibrations through an assembly to a lower structure adjacent to the assembly comprising disposing a vertical stack comprising a multiplicity of adjustment risers between a frame and a lower structure, said multiplicity absorbing mechanical vibrations transmitted through the frame thereby inhibiting transmission of the vibrations to the lower structure, the manhole or catch basin assembly being a manhole or catch basin assembly of the invention as defined hereinbefore.

In accordance with still another aspect of the invention there is provided a manhole or catch basin assembly frame comprising:

a molded frame member formed from a moldable material and having a peripheral frame side wall defining an access opening, said frame side wall having an upper end and a lower face extending outwardly of said access opening, said frame member being configured with a plurality of spaced apart cavities therein, effective to reduce the thickness of molded material at any point in the molded material to reduce the mold curing time of the moldable material during the molding of the molded frame.

DESCRIPTION OF PREFERRED EMBODIMENTS i) Manhole or Catch Basin Assembly

The manhole or catch basin assembly of the invention comprises separable component parts which assemble to a unitary structure which can be readily disassembled when necessary to replace damaged component parts, or, for example, to incorporate into the unitary assembly, additional component parts such as additional adjustment risers, an inflow insert for collecting water, paving adjusting rings which may be required to increase the total height of the assembly when the ground structure such as a road, in which, the assembly is mounted, is repaved such that the road surface is elevated. In such case it is necessary to increase the total height of the assembly so that the cover or closure of the assembly is substantially flush with the elevated, repaved surface, rather than being below the elevated, repaved surface.

The adjacent individual component parts of the manhole assembly mate so that the adjacent parts seal the assembly from surface and sub-surface water so as to inhibit entry of water into the assembly and between the components of the assembly.

The adjacent individual component parts of the catch basin assembly mate so that adjacent parts seal the assembly to inhibit leakage of sub-surface water; the catch basin assembly is intended to collect surface water.

The component parts can be installed without mechanical equipment and can be shipped in an assembly or partially assembled state, disassembled at the site of installation and re-assembled as the assembly is installed.

The component parts of the assembly are suitably molded, for example, compression molded, from various resilient materials including neoprene, styrene-butadiene rubber, EPDM (a terpolymer formed from ethylene-propylene diene monomer), masticated rubber, virgin rubber or recycled rubber. The risers and inflow insert may also be of more rigid plastic, for example, high density polyethylene.

The molded component parts have resilience and flexibility and can be physically compressed in a limited way.

The inflow insert and the paving adjusting ring interchangeably mate with the frame. The inflow insert is recessed into the frame so that it is disposed below the metal cover or closure which is supported by the frame, and is not subjected to shear forces from the cover. Likewise, when the paving adjusting ring is mated with the frame, the inflow insert is recessed into the paving adjusting ring and disposed below the metal cover or closure which is supported by the paving adjusting ring. In this way the inflow insert is not subjected to shear forces from the cover.

The molded frame and paving adjusting ring are typically up to 80% lighter than conventional cast iron frames and paving adjusting rings making them easier to handle and install, and they do not corrode.

The adjustment risers are self-sealing, stackable and dissipate load evenly.

The manhole or catch basin assembly and the component parts may be of any ring-like configuration defining an access passage to an underlying conduit; as such the individual component parts have matching access openings which in the assembly define the access passage. The ringlike configuration may be, for example, circular, elliptical or rectangular, and preferably the component parts have annular molded bodies.

ii) Adjustment Risers

The assembly includes at least one and preferably a multiplicity of mating, self-sealing, adjustment risers, the uppermost of which matingly, sealingly engages a lower face of the frame.

Each adjustment riser may have a single, continuous, elongate rib and a corresponding single, continuous, elongate groove; in preferred embodiments there are a plurality of parallel, spaced apart ribs and a corresponding plurality of parallel spaced apart grooves.

The lower face of the frame suitably has a single continuous, elongate rib which sealing mates with a groove of an upper face of an uppermost adjustment riser.

In the preferred embodiment in which the molded body is annular, the ribs are concentric as are the grooves.

Most suitably there are 1 to 5, and preferably 2 to 5 ribs and the same number of grooves, in a particular riser.

The adjustment riser has opposed first and second faces which will be parallel in many cases, however, it is also advantageous to have risers in which one of the first and second faces lies in a plane inclined at an acute angle to a plane containing the other of the faces, such that the riser is of a wedge shape.

Preferably each rib is convexly curved at its outer end, whereas each groove has a flat floor and opposed side walls extending perpendicularly of the flat floor.

However, it will be recognized that other configurations may be employed to provide the mating engagement between adjacent risers of a stack. Thus, the ribs may be convexly curved and the grooves may be concavely curved to match the convex curvature of the ribs.

It is especially preferred that the ribs have a vertical height which is slightly greater than the maximum vertical depth of the grooves. On assembly of the adjustment risers and the frame, the ribs are deformed, compressed or flattened at their exposed outer end into sealing engagement with the floor of the grooves. This deformation, compression or flattening of the exposed outer end of the rib against the floor of a groove results in a sealing area or sealing zone which inhibits passage of water between adjacent mating adjustment risers, and between the uppermost riser and the frame.

The sealing between the adjustment risers occurs both at the opposed flat faces of adjacent adjustment risers, and the uppermost riser and the frame, as well as between the deformed ribs and the floors of the mating grooves, as the load on the stacked adjustment risers increases. The load required to deform the ribs into sealing engagement with the grooves is less than that required for sealing the adjacent risers and the uppermost riser and the frame, at their opposed flat faces. In this way the sealing area formed by deformation of the outer ends of the ribs provides the primary seal and the seal formed as opposed flat faces of adjacent risers, and the uppermost riser and the frame, are pressed together under load, creates a secondary seal.

In use a multiplicity of the adjustment risers of the assembly is employed in a vertical stacked relationship to provide a required riser height to occupy the gap between the lower concrete adjustment riser or conduit and the upper frame in the assembly. The need to locate an adjustment riser of a necessary thickness is thus avoided and the required thickness or height is developed by stacking the risers in mating, sealing engagement. Additionally, since the required riser height can be developed by sequential stacking of relatively thin risers, lifting and handling of thick, heavy adjustment risers is avoided.

In the stacking of the adjustment risers the grooves on the first or upper face of a lower riser of a stack are matingly received in the corresponding ribs of the second or lower face of an adjacent upper riser. The grooves on the upper face of the uppermost riser matingly receive a corresponding rib on the lower face of the frame. In this regard the width of the grooves or the spacing between the side walls of the grooves, is slightly greater than the corresponding thickness dimension of the ribs. Additionally, the convexly curved outer ends of the ribs facilitate mating entry of the ribs into the grooves.

It will be understood that the grooves can also be located on the second or lower face and the ribs on the first or upper face; in this case, a groove would be located on the lower face of the frame to matingly receive a rib on the upper face of the uppermost adjustment riser.

The outer end of each rib forms a seal with the floor of its mating groove, and in the preferred embodiment the outer end of the rib is deformed, compressed or flattened against the groove floor to provide a significant area or zone of sealing contact. The sealing contact in conjunction with close spacing between the rib and the side walls of the groove also provides lateral stability between adjacent adjustment risers; in other words, the tendency of adjacent risers to slide or move laterally to one another is minimized.

In a location in which the maintenance hole is formed in an inclined surface such that the gap between the lower concrete riser and the upper frame varies in height in one direction, there may conveniently be employed a wedge-shaped riser, as the uppermost riser of the stack. In such case the upper or first face of the riser which bears the ribs, is in a plane which is inclined at an acute angle to the plane containing the lower or second face in which the grooves are formed and this latter face in use will be generally parallel with the faces of the lower risers of the stack.

iii) Frame

The frame has an outer seat and an adjacent inner seat in an upper end of the frame member; the outer seat circumscribes and is spaced above the lower seat. The inner seat is configured to mate with an upper assembly member which specifically may be the inflow insert or the paving adjusting ring, in a male/female relationship. The outer seat is configured to mate with the cover or closure, when the inner seat mates with the inflow insert; or with the paving adjusting ring, when the inner seat mates with the paving adjusting ring.

The frame member suitably has an inner cylindrical wall defining the access opening, with the lower seat extending outwardly of an upper end of the cylindrical wall.

In a preferred embodiment the upper seat has an annular floor and an annular wall circumscribing the annular floor, and the annular floor supports an outer circular zone of the lower face of the paving adjusting ring or the cover or closure.

Furthermore, the lower seat is configured to interchangeably matingly support an outer peripheral edge of an inflow insert and an inner portion of a lower profiled face of a paving adjusting ring; and the upper seat is configured to interchangeably matingly support an outer portion of a manhole or catch basin assembly cover for closing the access opening and an outer portion of the lower profiled face of the paving adjusting ring.

DESCRIPTION OF PREFERRED EMBODIMENTS WITH REFERENCE TO THE DRAWINGS

Figure 1:
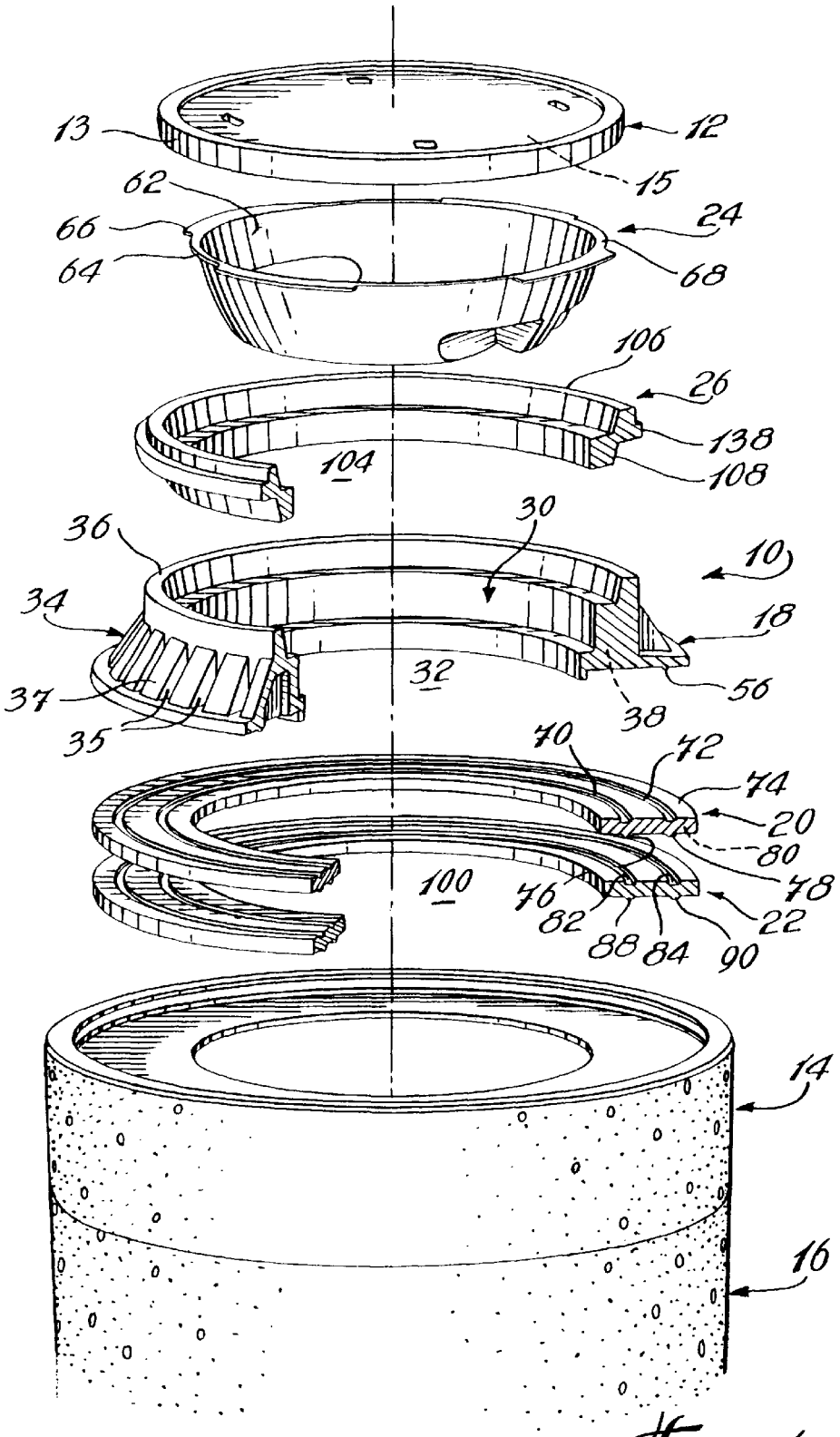
FIG. 1 is an exploded view of a manhole assembly in accordance with the invention; in conjunction with a closure or cover and a concrete support structure.

With further reference to FIG. 1, there is shown a manhole or catch basin assembly 10 having a cover 12, and which is to be supported on a concrete riser 14 disposed on a concrete conduit 16.

Assembly 10 includes a frame 18, adjustment risers 20 and 22, an inflow insert 24 and a paving adjusting ring 26.

Although two adjustment risers 20 and 22 are shown for the purposes of illustration, it will be understood that the assembly 10 may include a single adjustment riser 20 or a plurality of adjustment risers 20, 22. Additionally, it should be understood that paving adjusting ring 26 is optionally employed between frame 18 and inflow insert 24.

Cover 12 has an outwardly facing rim 13 and a lower face 15.

Frame 18, which is suitably a molded component, for example, of masticated rubber, has an inner cylindrical wall 30 which defines an access opening 32, an outer frusto-conical wall 34, an upper end 36 and a lower face 38.

Figure 3:
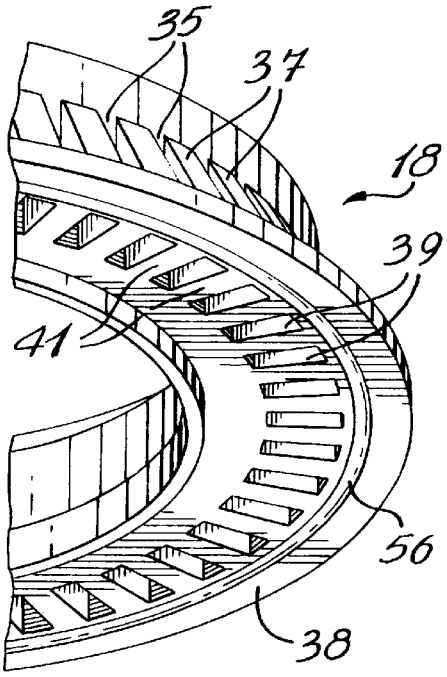
FIG. 3 is a perspective detail of the frame of the assembly of FIG. 1, particularly showing the underside of the frame.
Figure 5:
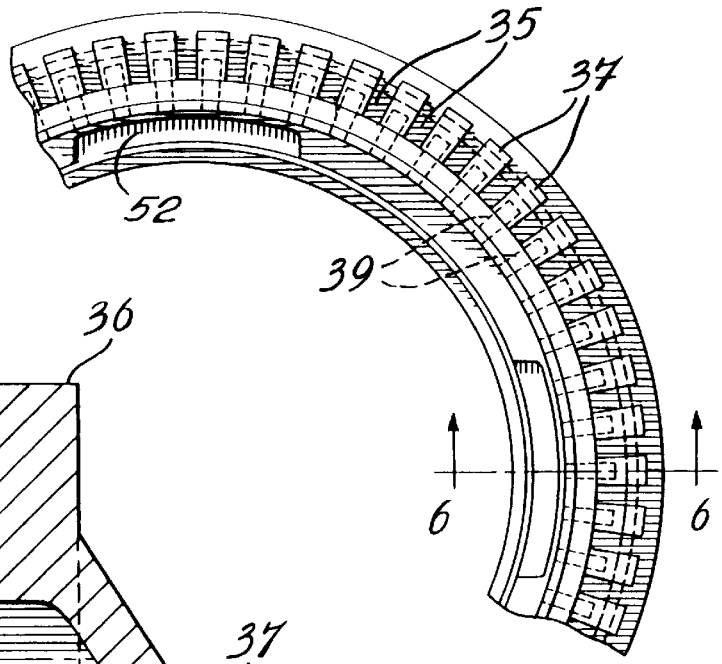
FIG. 5 is a top plan of a portion of the frame of FIG. 1.
Figure 6:
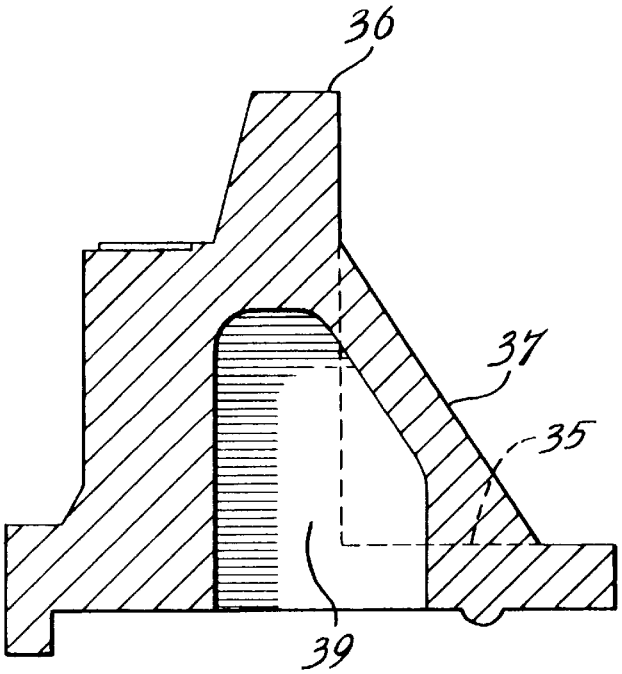
FIG. 6 is a cross-section on line 5—5 of FIG. 5.

As more especially shown in FIGS. 3 and 5, outer frusto-conical wall 34 has a plurality of cavities 35 in side-by-side relationship, adjacent cavities 35 being separated by a strut 37; and lower face 38 has a plurality of cavities 39 in side-by-side relationship, each cavity 39 being disposed below a strut 37 of outer-frusto-conical wall 34, and adjacent cavities 39 being separated by strut 41. In this way, cavities 35 and 37 are in an alternating relationship about frame 18. Each cavity 35 is disposed between a pair of adjacent cavities 37; and each cavity 37 is disposed between a pair of adjacent cavities 35.

Figure 2:
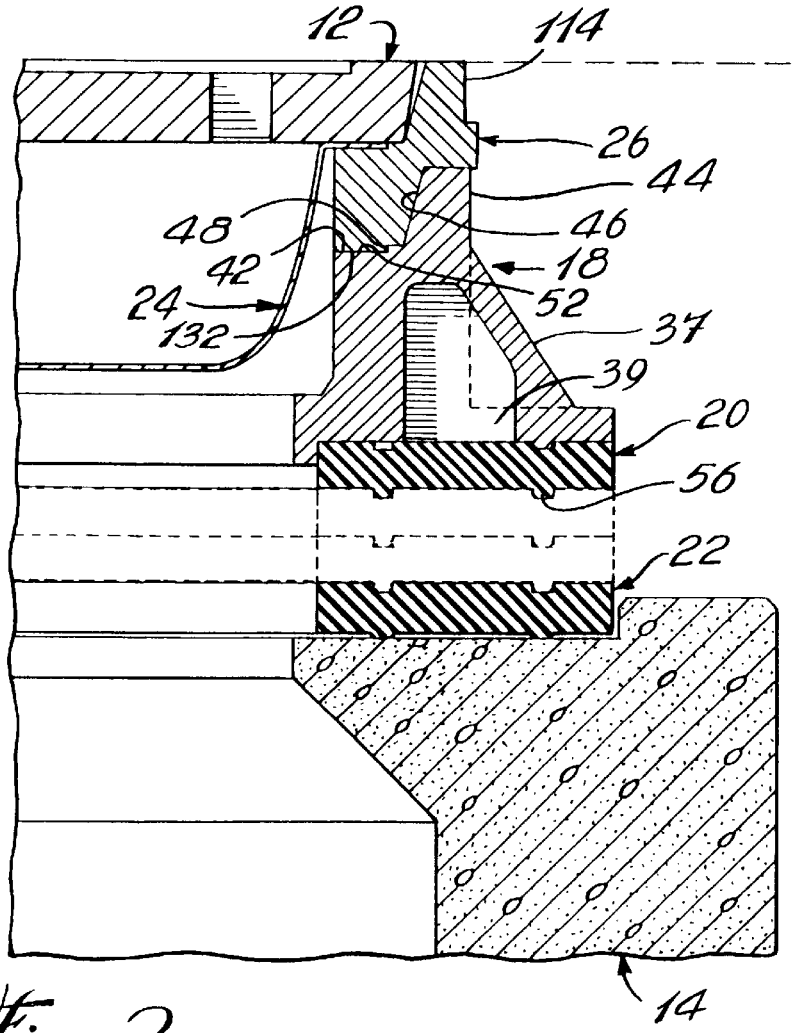
FIG. 2 is a partial cross-section of the assembly of FIG. 1, assembled on the concrete support structure with the closure or cover.
Figure 7:
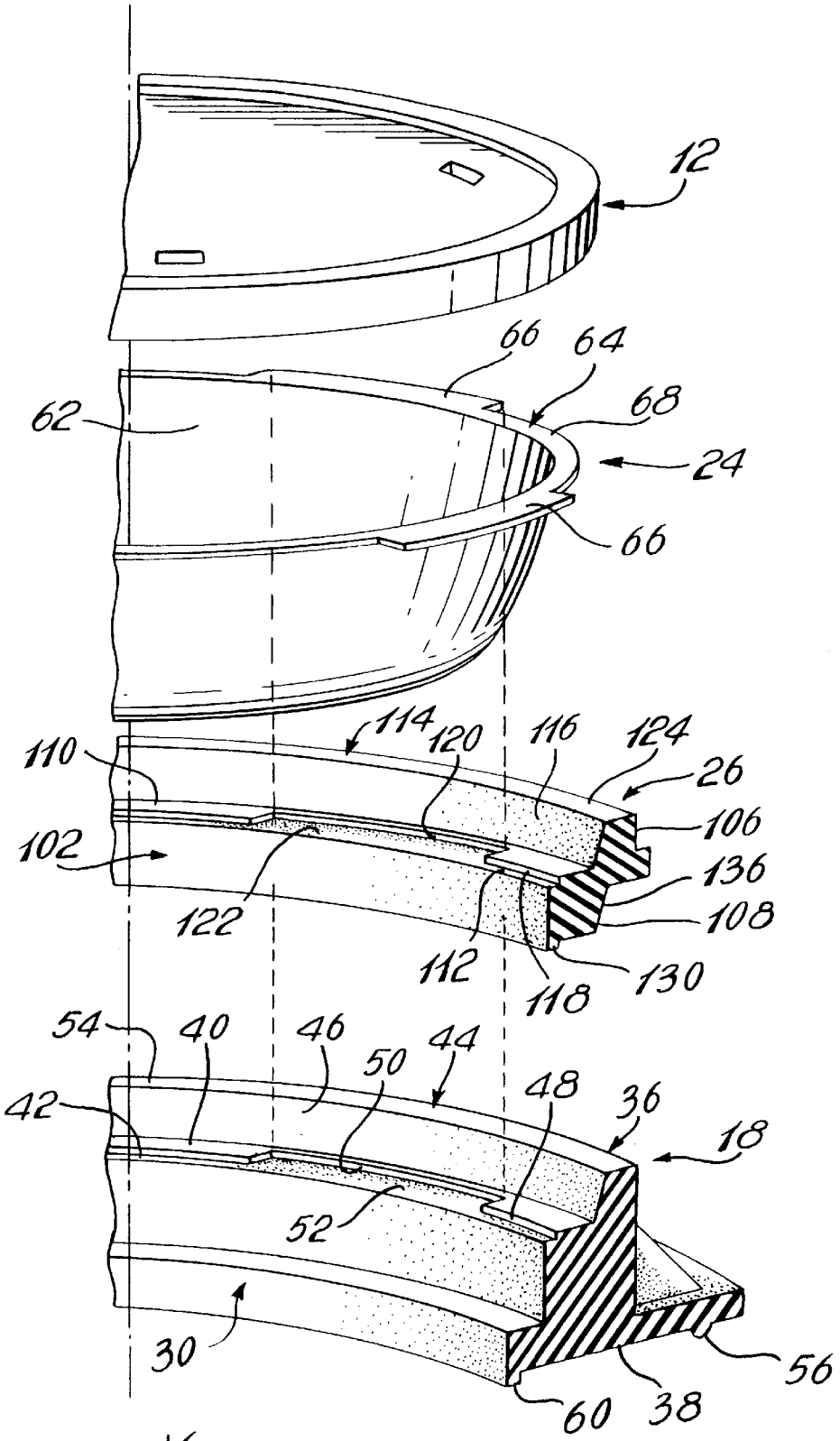
FIG. 7 is a detail of the exploded view in FIG. 1.

As more especially seen in FIGS. 2 and 7, upper end 36 includes an outer seat 40, an inner seat 42 and an annular rim 44.

Rim 44 defines a cylindrical outer seat wall 46. Inner seat 42 is spaced below outer seat 40 by a cylindrical inner seat wall 48.

A plurality of spaced apart recesses 50 in outer seat 40 define inner seat extensions 52, which extensions 52 extend radially outwardly of inner seat 42.

Rim 44 has a substantially flat top wall 54.

Lower face 38 has a single continuous rib 56 extending outwardly thereof and a cylindrical lip 60 extends downwardly from inner cylindrical wall 30 so as to project below lower face 38.

Inflow insert 24 includes a shallow basin 62 terminating at its upper end in an annular flange 64 having a plurality of spaced apart support projections 66. Annular flange 64 has a flat top face 68.

Adjustment riser 20 has a generally flat upper sealing face 74 and elongate continuous grooves 70 and 72 extend inwardly of face 74 in spaced apart, parallel, concentric relationship. One of the grooves 70 and 72 is disposed and configured to mate with the rib 56 on the lower face 38 of frame 18. While FIG. 1 particularly illustrates an embodiment in which frame 18 has a single rib 56, and adjustment riser 20 has two grooves 70 and 72, it will be recognized that the mating relationship may be achieved with a pair of concentric ribs 56 mating with the grooves 70 and 72, or with a plurality greater than 2 of the grooves and ribs. In particular, there may be 1 to 5 ribs, such as 56, and a corresponding 1 to 5 grooves, such as 70 and 72.

Adjustment riser 20 has a generally flat lower sealing face 80 with ribs 76 and 78 extending outwardly thereof.

Adjustment riser 22 is similar to adjustment riser 20 having grooves 82 and 84 on flat upper sealing face 86 and ribs 88 and 90 on flat lower sealing face 92, the grooves 82 and 84 being disposed and configured so as to mate with the ribs 76 and 78 in adjustment riser 20.

Figure 4:
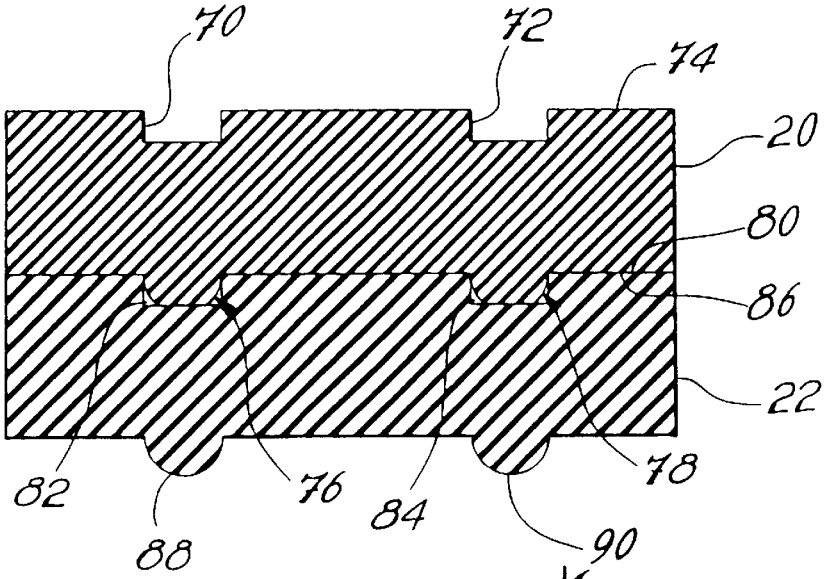
FIG. 4 illustrates schematically the stacking, sealing engagement between the adjustment risers in a manhole assembly of the invention.

As more particularly illustrated in FIG. 4, the grooves, such as 82 and 84, of the riser 22 each have a floor 94 and spaced apart side walls 96.

The adjustment risers 20, 22 together define an access opening 100 which aligns with access opening 32 of frame 18.

Paving adjusting ring 26 is an optional component which may be included in assembly 10 at the time of original installation, or which may be introduced subsequently between frame 18 and inflow insert 24 when the upper ground surface, for example, a road surface is repaved such that the road surface is increased in a manner which would result in the cover 12 which closes the assembly 10, being disposed below the elevated, repaved surface. The paving adjusting ring 26 may thus be employed to increase the height of assembly 10 so that cover 12 on the installed assembly 10 is substantially flush with the road surface.

As more especially shown in FIG. 7, paving adjusting ring 26 has a cylindrical inner wall 102 which defines an access opening 104 which aligns with access openings 32 and 100.

Paving adjusting ring 26 has an upper end 106 and a lower skirt 108.

An outer seat 110 and an inner seat 112 are defined in upper end 106 and upper end 106 terminates in a rim 114 which defines a cylindrical outer seat wall 116. Outer seat 110 is spaced above inner seat 112 by a cylindrical inner seat wall 118.

A plurality of spaced apart recesses 120 in outer seat 110 define inner seat extensions 122 in inner seat 112.

Rim 114 has a substantially flat top wall 124.

The cover 12 has an annular peripheral zone on its underside which is substantially flat.

Figure 8:
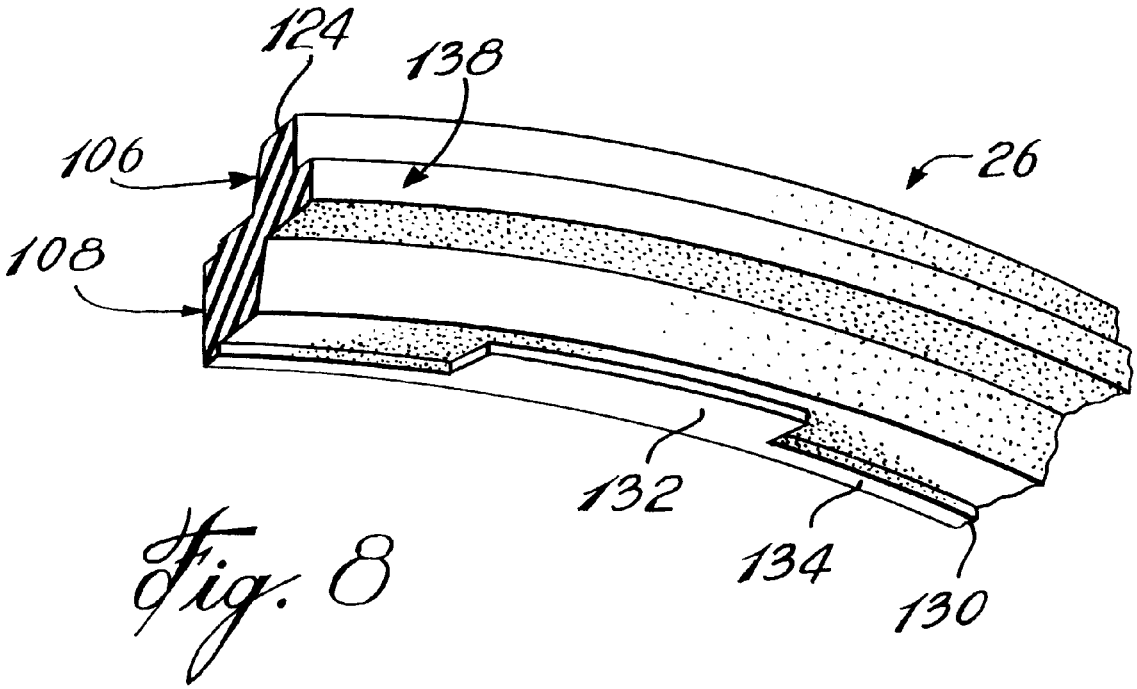
FIG. 8 is a detail of the underside of a paving adjusting ring employed in FIGS. 1 and 7.

As more especially shown in FIG. 8, lower skirt 108 of paving adjusting ring 26 has cylindrical outer walls 136 from which extends a downwardly extending annular lip 130; a plurality of spaced apart lip projections 132, extending radially outwardly of lip 130 on flat annular bottom wall 134 of skirt 108.

An intermediate rim 138 extends radially outwardly of paving adjusting ring 26 between upper end 106 and lower skirt 108.

In the installation of assembly 10 on a concrete riser 14 a required number of adjustment risers 20, 22 are vertically stacked in mating relationship so that, for example, the ribs 76 and 78 of riser 20 are matingly received in the grooves 82 and 84 of riser 22. The number of risers 20, 22 stacked in this manner depends on the desired vertical height or thickness to be achieved by the risers. Frame 18 is disposed on upper face 74 of riser 20 so that one of the grooves 70 and 72 matingly receives the rib 56 on the lower face 38 of frame 18. In this way sealing engagement is formed between the ribs and grooves of the risers 20, 22 and between riser 20 and frame 18. A secondary sealing is achieved by the area contact of the flat faces 80 and 86 of the risers 20 and 22 and between the flat face 74 of riser 20 and the lower face 38 of frame 18. Additionally the mating engagement between the ribs and grooves inhibits lateral displacement of the adjustment risers or frame relative to each other.

In one embodiment the inflow insert 24 is seated in the upper end 36 of frame 18. In this embodiment the annular flange 64 of pan 24 sits on inner seat 42 with support projections 66 mating with inner seat extensions 52 and the outer peripheral wall of annular flange 64 engaging the cylindrical inner seat wall 48 and the seat extension walls. The dimensions of the parts are such that flat top face 68 of annular flange 64 is suitably flush with, or slightly below, outer seat 40. In this embodiment cover 12 sits on outer seat 40 with inflow insert 24 disposed below it. Outer seat 40 is in sealing engagement with the annular peripheral zone 126 on the lower face 15 of cover 12 and the outer rim 13 of cover 12 engages the cylindrical outer seat wall 46 of frame 18.

In this way there is formed a unitary assembly in which the component parts snugly mate or fit together.

The afore-mentioned embodiment may be varied after installation such as when the road surface is repaved to an elevated height by the inclusion in the assembly 10 of paving adjusting ring 26. Alternatively, paving adjusting ring 26 may be included at the time of original installation.

The upper end 106 of paving adjusting ring 26 is of generally the same configuration as the upper end 36 of frame 18. Thus the upper end 106 of paving adjusting ring 26 has an inner seat 112 with a plurality of inner seat extensions 122 so that the inner seat 112 and inner seat extensions 122 may support the inflow insert 24 in the same way that frame 18 supports inflow insert 24 with the flat top face 68 of insert 24 flush with or slightly below the outer seat 110 of paving adjusting ring 26. The outer seat 110 and cylindrical outer seat wall 116 at the upper end 106 of paving adjusting ring 26 then support cover 12 in the same manner that cuter seat 40 and outer seat wall 46 of frame 18 support cover 12 in the first mentioned embodiment.

The lower skirt 108 of paving adjusting ring 26 has a configuration to mate with the outer seat 40 and inner seat 42 of frame 18. Thus, the annular lip 130 of lower skirt 108 sits on inner seat 42 of frame 18 while the lip projections 132 mate with the inner seat extensions 52 and the flat annular bottom wall 134 of skirt 108 sits on outer seat 40 of frame 18 while the cylindrical outer wall 136 of skirt 108 is in mating engagement with cylindrical outer seat wall 46 of frame 18.

The intermediate rim 138 of paving adjusting ring 24 sits on the flat top wall 54 of rim 44 of frame 18.

In this way paving adjusting ring 26 acts as an extension to upper end 36 of frame 18 to increase the vertical height and elevate the support positions for the cover 12 and the underlying catch pan 24.

The mating sealing engagement between the component parts of assembly 10 and between assembly 10 and cover 12 inhibit relative movement of the parts after installation and provide a sealed assembly which substantially inhibits passage of water between the adjacent mating parts.

Cover 12 particularly includes holes to facilitate grasping of the cover for its removal and these holes permit some access of surface water into the assembly, such surface water being collected in basin 62 of insert 24. This basin 62 is periodically emptied.

With further reference to FIG. 2, it can be seen that the ribs 76, 78, 88 and 90 have convexly curved outer ends and that the mating grooves 70 and 72 in riser 20 and 82 and 90 in riser 22 have a generally flat floor with perpendicular side walls, such as floor 94 and side walls 96 and 98 in riser 22. It is preferred that the distance between side walls such as 96 and 98 be only slightly greater than the width of the ribs such as 76 to ensure a snug fit. Additionally, the various grooves such as 82 and 84 preferably have a depth slightly less than the height of a rib such as 76, 78, so that the resilience of the molded body of the risers such as 20, in conjunction with the overall weight of the assembly 10, deforms or compresses and flattens the convexly curved outer ends of the ribs for better sealing engagement, when the risers and frame of the assembly 10 are stacked.

In this way and by reference to FIG. 2, the upper face 86 of riser 22, is supported in sealing engagement with lower face 80 of riser 20 and ribs 76 and 78 sealingly engage the groove floors of grooves 82 and 84. The close spacing of groove side walls such as 96 and 98 with a mating rib provide lateral stability.

It will be understood that other configurations for the ribs and grooves can be employed, for example, the grooves may be concavely curved with a curvature slightly greater than the curvature of the ribs.

Additionally, one or more of the risers 20, 22, may be wedge-shaped, having a thickness which varies in one direction from a thick end to a thin end so that one face is inclined at an acute angle to the other face. One or more such wedge-shaped risers may be employed in the vertical stack to ensure that the upper face of the stack of risers is in a horizontal plane, or so as to incline the frame 18 and cover 12 to match an inclination in the road surface.

The cavities 35 in wall 34 of frame 18, and the cavities 39 in lower face 38 of frame 18 serve to reduce the weight of frame 18, and also the amount of material required for molding of frame 18. The cavities 35 and 39 in conjunction with struts 37 and 41 are dimensioned and configured to reduce the thickness of molded material at any point in the frame 18. By avoiding the presence of thick portions, or in any event by reducing the thickness of molded material at any point in the frame, the mold curing time is reduced, and preferably minimized, consistent with retaining the structural integrity and required strength characteristics of the frame 18.

It will be recognized that variations in the structure and composition as defined hereinbefore may be made without departing from the invention.

I claim:

1. A manhole or catch basin assembly frame comprising:

i) a molded frame member having a peripheral frame wall defining an access opening, said frame wall having an upper end and a lower face extending outwardly of said access opening, said molded frame member being compression molded of resilient material, ii) seat means defined in said upper end, said seat means comprising an upper outer seat and a lower inner seat, said upper seat circumscribing and being spaced above said lower seat, iii) said upper outer seat comprising a seat floor and an inwardly facing seat wall extending upwardly of an outer edge of said seat floor, iv) said lower inner seat being able to matingly support an outer peripheral edge of an upper assembly member disposed above said frame, and said upper outer seat being able to matingly support said upper assembly member or a further assembly member disposed above said frame, with an outer zone of a lower face of said upper assembly member or said further assembly member engaging said seat floor and said inwardly facing seat wall of said upper outer seat, v) said lower face of said frame wall having means to matingly engage an adjustment riser such that lateral movement of the adjustment riser relative to the frame member is inhibited.

2. A frame according to claim 1, wherein said lower seat is configured to mate with the assembly member in a male/female relationship, and said upper seat is configured to mate with said upper assembly member or said further assembly member.

3. A frame according to claim 1, wherein said frame member has an inner cylindrical wall defining said access opening and said lower seat extends outwardly of an upper end of said cylindrical wall; said seat floor of said upper outer seat comprising an annular floor and said inwardly facing seat wall of said upper seat comprising an annular wall circumscribing said annular floor, said annular floor and annular wall being adapted to support an outer circular zone of the lower face of the upper assembly member or the further assembly member.

4. A frame according to claim 3, wherein said lower inner seat is configured to interchangeably matingly support an outer peripheral edge of an inflow insert as said further assembly member and an inner portion of a lower profiled face of a paving adjusting ring as said further assembly member; and said upper outer seat is configured to interchangeably matingly support an outer portion of a manhole or catch basin assembly cover for closing the access opening and an outer portion of said lower profiled face of the paving adjusting ring.

5. A frame according to claim 4 wherein said;

frame member is configured with a plurality of spaced apart cavities therein, effective to reduce the thickness of molded material at any point in the molded material to reduce the mold curing time of the moldable material during the molding of the molded frame.

6. A frame according to claim 1 wherein said frame member has a plurality of cavities therein disposed so as to reduce the thickness of the frame member at any point therein.

7. A frame according to claim 1, wherein said molded frame member is compression molded from neoprene, styrene-butadiene rubber, EPDM, masticated rubber compound, virgin rubber or recycled rubber.

8. A manhole or catch basin assembly comprising:

a) a molded frame member having a peripheral frame wall defining an access opening, said frame wall having an upper end and a lower face extending outwardly of said access opening, said molded frame member being compression molded of resilient material, b) seat means defined in said upper end, said seat means comprising an upper outer seat and a lower inner seat, said upper outer seat circumscribing and being spaced above said lower inner seat, said upper outer seat comprising a seat floor and an inwardly facing seat wall extending upwardly of an outer edge of said floor, c) a molded upper assembly member having a peripheral wall defining said access opening, matingly supported by said upper seat, with an outer zone of a lower face of said upper assembly member engaging said seat floor and said inwardly facing seat wall of said upper outer seat, d) a molded first adjustment riser matingly engaging said lower face of said frame member such that lateral movement of the adjustment riser relative to the frame member is inhibited.

9. An assembly according to claim 8, wherein said first adjustment riser is one of a multiplicity of interchangeable adjustment risers, adjacent adjustment risers of said multiplicity being matingly engageable such that relative lateral movement of the risers is inhibited.

10. An assembly according to claim 9, wherein said upper assembly member is a paving adjusting ring having a peripheral paver wall defining said access opening:

said paving adjusting ring having an upper end and a configured lower end, said configured lower end being matingly supported by said upper and lower seats;

paver seat means in said upper end of said paving adjusting ring comprising an upper, outer paver seat and a lower, inner paver seat, said upper paver seat circumscribing and being spaced above said lower paver seat; and further including:

e) an inflow insert having an outer peripheral edge matingly supported by said lower paver seat, and f) a cover matingly supported by said upper paver seat over said inflow insert to close said access opening.

11. An assembly according to claim 9, wherein each adjustment riser comprises:

a molded body having an inner peripheral wall and an outer peripheral wall, said inner peripheral wall defining said access opening, first and second, spaced apart, opposed sealing faces extending between said inner and outer peripheral walls, at least one continuous, elongate rib extending outwardly of said first face and a corresponding number of continuous, elongate grooves in said second face, each at least one rib being in opposed relationship with a said groove, and being matingly received by a corresponding groove in a mating riser having a similar molded body.

12. An assembly according to claim 11, wherein said frame member has an inner cylindrical wall and said molded body is annular, said first face having a plurality of spaced apart, elongate, parallel concentric ribs extending outwardly thereof, and said second face having a same plurality of spaced apart, elongate, parallel, concentric grooves therein, each rib of said plurality being in opposed relationship with a groove of said same plurality.

13. An assembly according to claim 12, wherein each rib has a convexly curved outer end and each groove has a flat floor and opposed side walls extending perpendicularly of said flat floor, and each elongate rib has a vertical height greater than the corresponding vertical depth of a mating groove of a mating riser such that in mating, an outer end of the rib is deformed into sealing engagement with the mating groove, said risers being matingly, vertically, stackable with the at least one rib of a lower riser matingly received in a corresponding groove in an adjacent upper riser.

14. An assembly according to claim 11, wherein the molded body of each riser is annular, each riser having a said first face with a plurality of spaced apart, elongate, parallel, concentric ribs extending outwardly thereof, and a said second face with a same plurality of spaced apart, elongate, parallel, concentric grooves therein, each rib of said plurality being in opposed relationship with a groove of said same plurality and each rib has a vertical height greater than the corresponding vertical depth in the corresponding groove with which it mates, such that in mating the outer end of each rib is deformed into sealing engagement with the floor of the mating groove, and the side walls of each groove are closely spaced to its mating rib during mating so as to provide lateral stability between the risers in the assembly.

15. An assembly according to claim 9, wherein said upper assembly member is a cover member for closing said access opening and further including an inflow insert having an outer peripheral edge matingly supported by said lower seat, said cover member being supported by said upper seat over said inflow insert.

16. An assembly according to claim 8, wherein said molded frame member is compression molded from neoprene, styrene-butadiene rubber, EPDM, masticated rubber compound, virgin rubber or recycled rubber.

17. In an assembly of a lower structure and a manhole or catch basin assembly in which the manhole or catch basin assembly is exposed to vibration generating impacts, the vibrations being transmissible through said manhole or catch basin assembly to said lower structure, and wherein said manhole or catch basin assembly has an adjustment means to absorb mechanical vibrations transmitted through said assembly and inhibit transmission of the vibrations to the lower structure, the improvement wherein said assembly comprises:

a) a molded frame member having a peripheral frame wall defining an access opening, said frame wall having an upper end and a lower face extending outwardly of said access opening, said molded frame member being compression molded of resilient material b) seat means defined in said upper end, said seat means comprising an upper outer seat and a lower inner seat, said upper outer seat circumscribing and being spaced above said lower inner seat, said upper outer seat comprising a seat floor and an inwardly facing seat wall extending upwardly of an outer edge of said seat floor, c) a molded upper assembly member having a peripheral wall defining said access opening, matingly supported by said upper seat, with an outer zone of a lower face of said upper assembly member engaging said seat floor and said inwardly facing seat wall of said upper outer seat, and said adjustment means comprises a vertical stack comprising a multiplicity of risers, each riser comprising:

a molded body having an inner peripheral wall and an outer peripheral wall, said inner peripheral wall defining said access opening, first and second, spaced apart, opposed sealing faces extending between said inner and outer peripheral walls, at least one continuous, elongate rib extending outwardly of said first face and a corresponding number of continuous, elongate grooves in said second face, each at least one rib being in opposed relationship with a said groove, and being matingly received by a corresponding groove in a mating riser having a similar molded body, and wherein said risers are matingly stacked between said lower face of said frame member and said lower structure in which said at least one groove of a first riser in said stack matingly receives a corresponding rib in an adjacent riser in said stack, and an uppermost riser of said multiplicity matingly engages said lower face of said frame member such that lateral movement of the risers relative to the frame member is inhibited.

18. An assembly according to claim 17, wherein said molded body of each said riser is annular, said first face having a plurality of spaced apart, elongate, parallel, concentric grooves therein, and said second face having a same plurality of spaced apart, elongate, parallel, concentric ribs extending outwardly thereof, each rib of said plurality being in opposed relationship with a groove of said same plurality.

19. An assembly according to claim 18, wherein said plurality is 1 to 5; each rib has a vertical height greater than the corresponding vertical depth in the corresponding groove with which it mates, such that in mating the outer end of each rib is deformed into sealing engagement with the floor of the mating groove; and the side walls of each groove are closely spaced to its mating rib during mating so as to provide lateral stability between the risers in the assembly.

20. An assembly according to claim 19, wherein said upper assembly member is a cover member for closing said access opening and further including an inflow insert having an outer peripheral edge matingly supported by said lower seat, said cover member being supported by said upper seat over said inflow insert.

21. An assembly according to claim 19, wherein said upper assembly member is a paving adjusting ring having a peripheral paver wall defining said access opening:

said paving adjusting ring having an upper end and a configured lower end, said configured lower end being matingly supported by said upper and lower seats;

paver seat means in said upper end of said paving adjusting ring comprising an upper, outer paver seat and a lower, inner paver seat, said upper paver seat circumscribing and being spaced above said lower paver seat; and further including:

e) an inflow insert having an outer peripheral edge matingly supported by said lower paver seat, and f) a cover matingly supported by said upper paver seat over said inflow insert to close said access opening.

22. An assembly according to claim 19, wherein said molded frame, said molded upper assembly member and said molded body are of masticated rubber.

23. An assembly according to claim 17, wherein said molded frame member is compression molded from neoprene, styrene-butadiene rubber, EPDM, masticated rubber compound, virgin rubber or recycled rubber.

24. A method of inhibiting transmission of mechanical vibrations through an assembly to a lower structure adjacent to the assembly comprising disposing a vertical stack comprising a multiplicity of adjustment risers between a frame and the lower structure, said multiplicity absorbing mechanical vibrations transmitted through the frame thereby inhibiting transmission of the vibrations to the lower structure, said assembly comprising:

a) a molded frame member having a peripheral frame wall defining an access opening, said frame wall having an upper end and a lower face extending outwardly of said access opening, said molded frame member being compression molded of resilient material b) seat means defined in said upper end, said seat means comprising an upper outer seat and a lower inner seat, said upper outer seat circumscribing and being spaced above said lower inner seat, said upper outer seat comprising a seat floor and an inwardly facing seat wall extending upwardly of an outer edge of said floor, c) a molded upper assembly member having a peripheral wall defining said access opening, matingly supported by said upper outer seat, with an outer zone of a lower face of said upper assembly member engaging said seat floor and said inwardly facing seat wall of said upper outer seat, each riser of said multiplicity comprising:

a molded body having an inner peripheral wall and an outer peripheral wall, said inner peripheral wall defining the access opening, first and second, spaced apart, opposed sealing faces extending between said inner and outer peripheral walls, at least one continuous, elongate rib extending outwardly of said first face and a corresponding number of continuous, elongate grooves in said second face, each at least one rib being in opposed relationship with a said groove, and being matingly received by a corresponding groove in a mating riser having a similar molded body, said risers being matingly stacked such that a said at least one rib of a first riser in said stack is matingly received in a corresponding groove in an adjacent riser in said stack, and an uppermost riser of said multiplicity matingly engaging said lower face of said frame member such that relative movement of the risers relative to the frame member is inhibited.

25. A method according to claim 24, wherein said molded frame member is compression molded from neoprene, styrene-butadiene rubber, EPDM, masticated rubber compound, virgin rubber or recycled rubber.

26. A manhole or catch basin assembly frame comprising:

a molded frame member formed from a compression moldable resilient material and having a peripheral frame side wall defining an access opening, said frame side wall having an upper end and a lower face extending outwardly of said access opening, said frame member being configured with a plurality of spaced apart cavities therein, effective to reduce the thickness of molded material at any point in the molded material to reduce the mold curing time of the moldable material during the molding of the molded frame.

27. A frame according to claim 26 wherein said peripheral frame side wall has a first plurality of said cavities therein, in side-by-side relationship, adjacent cavities of said first plurality being separated by a side wall strut;

and said lower face of said frame wall has a second plurality of said cavities, in side-by-side relationship, adjacent cavities of said second plurality being separated by a bottom face strut.

28. A frame according to claim 26, wherein said molded frame member is compression molded from neoprene, styrene-butadiene rubber, EPDM, masticated rubber compound, virgin rubber or recycled rubber.

29. A manhole or catch basin assembly frame comprising:

a molded frame member formed from a moldable material and having a peripheral frame side wall defining an access opening, said frame side wall having an upper end and a lower face extending outwardly of said access opening, said frame member being configured with a plurality of spaced apart cavities therein, effective to reduce the thickness of molded material at any point in the molded material to reduce the mold curing time of the moldable material during the molding of the molded frame, and wherein said peripheral frame side wall has a first plurality of said cavities therein, in side-by-side relationship, adjacent cavities of said first plurality being separated by a side wall strut;

and said lower face of said frame wall has a second plurality of said cavities, in side-by-side relationship, adjacent cavities of said second plurality being separated by a bottom face strut, and wherein each cavity of said second plurality is disposed below a side wall strut such that said cavities of said first and second pluralities are in an alternating relationship about said frame, each cavity of the second plurality being disposed between two adjacent cavities of the first plurality; and each cavity of the first plurality being disposed between two adjacent cavities of the second plurality.

30. An assembly according to claim 29, wherein each rib has a convexly curved outer end and each groove has a flat floor and opposed side walls extending perpendicularly of said flat floor, and each elongate rib has a vertical height greater than the corresponding vertical depth of a mating groove of a mating riser such that in mating, an outer end of the rib is deformed into sealing engagement with the mating groove between the opposed side walls of the mating groove, said risers being matingly, vertically, stackable with the at least one rib of a lower riser matingly received in a corresponding groove in an adjacent upper riser.

31. A manhole or catch basin assembly comprising:

a) a molded frame member having an inner cylindrical frame wall defining an access opening, said frame wall having an upper end and a lower face extending outwardly of said access opening, b) seat means defined in said upper end, said seat means comprising an upper outer seat and a lower inner seat, said upper outer seat circumscribing and being spaced above said lower inner seat, c) a molded upper assembly member having a peripheral wall defining said access opening, matingly supported by said upper seat, d) a multiplicity of interchangeable adjustment risers, adjacent adjustment risers of said multiplicity being matingly engageable such that relative lateral movement of the risers is inhibited, a first adjustment riser of said multiplicity matingly engaging said lower face of said frame member such that lateral movement of the first adjustment riser relative to the frame member is inhibited, e) each adjustment riser of said multiplicity comprising an annular molded body having an inner peripheral wall and an outer peripheral wall, said inner peripheral wall defining said access opening, first and second, spaced apart, opposed sealing faces extending between said inner and outer peripheral walls, a plurality of spaced apart, elongate, parallel concentric ribs extending outwardly of said first face and a corresponding plurality of continuous, elongate, parallel, concentric grooves in said second face, each rib being in opposed relationship with a said groove, and being matingly received by a corresponding groove in a mating riser, and f) said plurality being 2 to 5, and said molded frame member and said molded body being compression molded bodies of neoprene, styrene-butadiene rubber, EPMD, masticated rubber compound, virgin rubber or recycled rubber.

* * * * *